United States Patent [19]

Szepesi

[11] Patent Number: 4,645,999

[45] Date of Patent: Feb. 24, 1987

[54] CURRENT MIRROR TRANSIENT SPEED UP CIRCUIT

[75] Inventor: Tamas S. Szepesi, Cupertino, Calif.

[73] Assignee: National Semiconductor Corporation, Santa Clara, Calif.

[21] Appl. No.: 827,049

[22] Filed: Feb. 7, 1986

[51] Int. Cl.[4] ..... G05F 3/20

[52] U.S. Cl. ..... 323/315; 323/901

[58] Field of Search ..... 323/312, 315, 316, 901; 307/296 R, 297

[56] References Cited

U.S. PATENT DOCUMENTS 3,895,239 7/1975 Alaspa ..... 307/296 R
4,567,426 1/1986 van de Plassche et al. ..... 323/312
4,574,232 3/1986 Petty ..... 323/901

FOREIGN PATENT DOCUMENTS 181959 10/1984 Japan ..... 307/297

OTHER PUBLICATIONS

IBM Technical Disclosure Bulletin, vol. 27, No. 11, Apr. 1985, p. 6285.

*Primary Examiner*—Peter S. Wong
*Assistant Examiner*—Judson H. Jones
*Attorney, Agent, or Firm*—Gail W. Woodward; Paul J. Winters

[57] ABSTRACT

A speed up circuit for a current mirror is disclosed. The turn on drive current is greatly increased for a brief transient interval. The increased current acts to rapidly charge circuit load capacitance and thereby reduce turn on time.

6 Claims, 5 Drawing Figures

CURRENT MIRROR TRANSIENT SPEED UP CIRCUIT

BACKGROUND OF THE INVENTION

Current mirrors are extensively used in integrated circuit (IC) devices. Their main function is in so-called turnaround circuits where a current sink is turned into a current source or vice versa. Such an action shifts the circuit voltage level so that a substantial potential level shift can be achieved without losing the d-c reference level.

Reference is made to U.S. Pat. No. 4,528,496 which issued July 9, 1985. This patent, by Toyojiro Naokawa and Matsuro Koterasawa, is titled CURRENT SUPPLY FOR USE IN LOW VOLTAGE IC DEVICES, and assigned to the assignee of the present application. The patent is directed to a current mirror that operates at low supply levels and it teaches the basic current mirror configurations. The teaching in the patent is incorporated herein by reference.

In certain circuit applications, particularly those in which a capacitive load is being driven, it can be advantageous to speed up the circuit turn on and also to provide a current overshoot for a short period of time after turn on to increase the slew rate. One such application is the driving of the switching devices in a buck-type switching regulator power supply. Another is the base discharge of a grounded emitter power switching transistor.

SUMMARY OF THE INVENTION

It is an object of the invention to provide a transient speed up circuit in a current mirror.

It is a further object of the invention to provide a current mirror circuit with a capability of a substantial transient current output overshoot when it is first turned on.

These and other objects are achieved as follows. A pair of transistors are coupled together to provide a current mirror operation. Their sizes are ratioed to provide the desired current mirror gain. The transistor bases are coupled together by means of a pair of resistors which are ratioed inversely as the mirror current gain. That is the larger resistor is associated with the lower current transistor. The collector current of the input transistor is forced to be equal to the input current of the current mirror by negative feedback realized by an emitter follower transistor which has its base coupled to the input transistor collector and its emitter coupled to the juncture of the two base resistors. A capacitor is coupled between the emitter and base of the mirror input transistor and a diode is coupled between the resistor juncture and the base of the mirror output transistor. The diode is poled to be conductive when the emitter follower is turned on. Two output transistor configurations are contemplated. In the first, the emitter follower collector is returned directly to the appropriate supply terminal to form a super-diode type current mirror. In the second, the emitter follower emitter is also coupled to the mirror output transistor collector and the emitter follower collector becomes the mirror output terminal in a Wilson-type current mirror. When the circuit is first turned on the input transistor base to emitter capacitor will be uncharged and the input transistor will remain non-conductive until the capacitor can charge. Under this condition the mirror input current is transferred to the output transistor via the diode.

This produces a current transient at high current gain. This action will provide for a fast rising output transient current pulse with substantial overshoot at turn on. Then, after a brief transient interval, the input transistor capacitor will charge up and the input transistor will turn on. At this point, the circuit will act as a normal current mirror.

DESCRIPTION OF THE INVENTION

Figure 1:
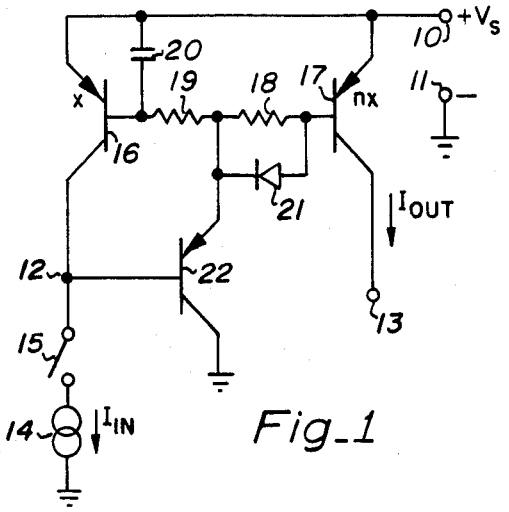
FIG. 1 is a schematic diagram of the circuit of the invention.

The schematic diagram of FIG. 1 shows the basic concept of the invention using PNP transistors. It is to be understood that while PNP transistors are shown and described, the complementary form of circuit using NPN transistor can also be employed. A current mirror is operated from a $V_S$ power supply connected to terminal 10 and—to ground terminal 11. The circuit input at node 12 is provided with an input current which is mirrored at output terminal 13. The input $I_{IN}$ is provided by a constant current device 14 which is actuated by means of switch 15. In the following discussions it is assumed that high Beta transistors are employed so that the base currents can be ignored relative to the collector currents. With a Beta in excess of 100 the base current will be less than 1% of the collector current and this approximation is valid to a first order.

Input transistor 16 is coupled as a current mirror to output transistor 17. The emitter area of transistor 17 is made n time that of transistor 16 so that the mirror has a current gain of n. This means that $I_{OUT}-nI_{IN}$.

The transistor bases are coupled together with a pair of series-connected resistors 18 and 19. These resistors are ratioed with the same factor as transistors 16 and 17 so that $R_{18}=R_{19}/n$. Thus, in operation, the voltage drops across resistors 18 and 19 are equal and opposite. Capacitor 20 forms a low pass filter with resistor 19. In the event that the emitter-base capacitance of transistor 16 is sufficient, as will often be the case using lateral PNP transistor construction, the physical capacitor 20 can be omitted. A diode 21 is connected in parallel with resistor 18 and poled to be conductive when transistor 17 is to be pulsed on. The voltage drop on resistor 18 is made smaller than a diode drop after the turn-on transient has elapsed, consequently diode 21 has no affect on the static operation of the circuit.

When switch 15 is open there is zero $I_{IN}$ at node 12. The circuit will be non-conductive and all of the transistors will be off. $I_{OUT}$ at terminal 13 is zero.

Figure 2:
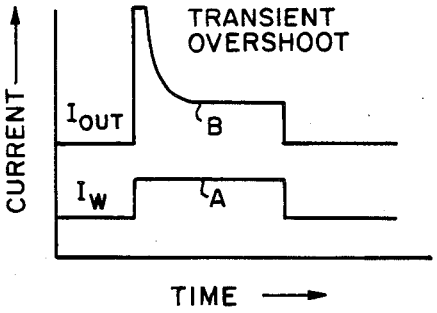
FIG. 2 is a graph showing the performance of the FIG. 1 circuit.

When switch 15 is closed $I_{IN}$ will flow out of node 12 and transistor 22 will be turned on. Its emitter current will turn diode 21 and transistor 17 on so that a large $I_{OUT}$ will flow at terminal 13. This is shown in FIG. 2 where waveform A represents $I_{IN}$ and waveform B represents $I_{OUT}$. As can be seen, the transient overshoot produces a large initial peak current. Since this transient includes the cascaded current gains of transistors 22 and 17 the current flow at terminal 13 will be limited primarily by the saturation of transistor 17 and partly by the current gain of transistor 16 in combination with the time constant of the low pass filter composed of resistor 19 and capacitor 20. During the transient interval, capacitor 20 will charge and after a suitable time interval, transistor 16 will turn on so as to conduct $I_{IN}$. Once this occurs, transistor 16 will act as the input device of the current mirror and determine the output current $I_{OUT}$ at n times $I_{IN}$. Transistor 22 provides a super gain current mirror action and diode 21 will no longer conduct. The duration of the transient overshoot is determined by the delay introduced by the resistor 19-capacitor 20 low pass filter.

The above-described current transient provides substantial speed up for the output voltage rise at turn-on. This is particularly important when the mirror is employed to drive a capacitive load fast or if it is employed as the driver of the power switch in a switching regulator where substantial turn on current overshoot is necessary to supply the recovery charge of the diode.

Figure 3:
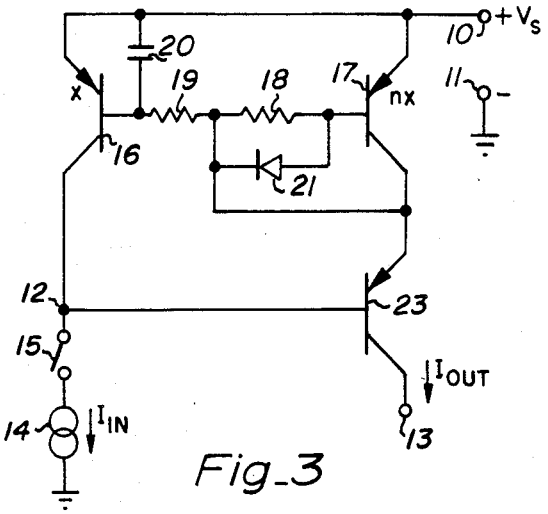
FIG. 3 is a schematic diagram of an alternative embodiment of the invention.

FIG. 3 is a schematic diagram of an alternative embodiment of the invention. Where the same elements are involved, the numerals of FIG. 1 are employed. The juncture of resistors 18 and 19 is returned to the collector of transistors 17 which is thereby caused to operate as a diode. The base of transistor 23 is connected to node 12 and its emitter returned to the juncture of resistors 18 and 19 thereby forcing the collector current of transistor 16 equal $I_{IN}$. The collector of transistor 23 provides the circuit output, $I_{OUT}$, at terminal 13. This creates the well-known Wilson current mirror configuration.

The main difference of the FIG. 3 circuit from that of FIG. 1 is that during the turn on transient, only one transistor Beta is present between node 12 and terminal 13. Also, transistor 23 operates in cascode with transistor 17 so that any load coupled to terminal 13 is isolated from mirror output transistor 17 whereby the output resistance of the circuit is substantially increased. When transistor 23 conducts, during the turn on transient period, it turns diode 21 on so as to turn transistor 17 on.

Figure 4:
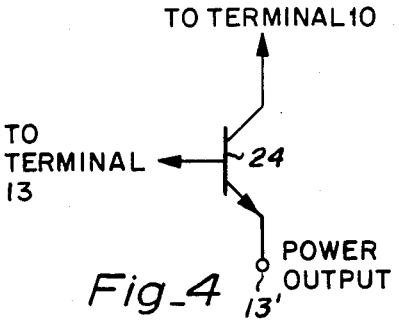
FIG. 4 is a schematic diagram of a power output transistor which can be employed in the circuits of FIG. 1 or FIG. 3.

FIG. 4 shows a power transistor 24 which can be connected to either of the circuits of FIGS. 1 and 3 to increase the output current drive characteristic. The base is coupled to terminal 13 and the collector is returned to $+V_S$ at terminal 10. The emitter 13' becomes the circuit output node. With transistor 24 in the circuit the output drive current at terminal 13' can be substantially increased.

Figure 5:
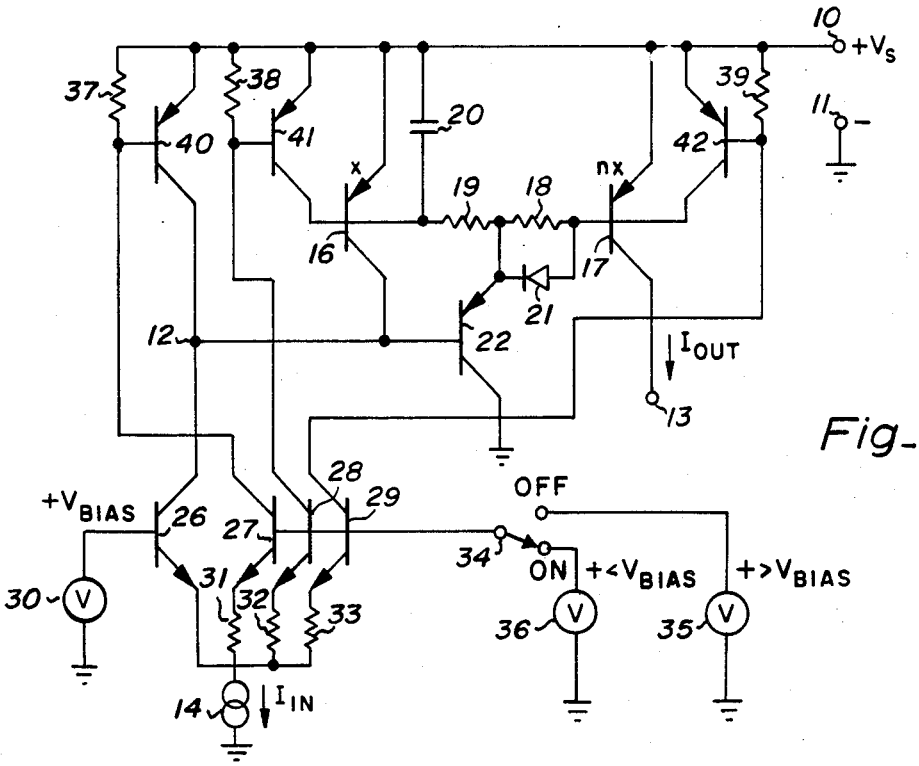
FIG. 5 is a schematic diagram of a circuit operating from a voltage-controlled differential signal current supply.

FIG. 5 is a schematic diagram showing how the FIG. 1 circuit can be embelished for voltage controlled operation. Where the parts are similar the same numerals are employed.

Switch 15 of FIG. 1 is replaced with a differential control circuit. $I_{IN}$ current supply 14 is coupled to the emitter of transistors 26–29. The base of transistor 26 is coupled to $V_{BIAS}$ supply 30. The emitters of transistors 27–29 are respectively coupled by current ratioing resistors 31–33 to current supply 14. The bases of transistors 27–29 are coupled to switch 34 which can select either constant voltage supply 35, which is larger than $V_{BIAS}$ or constant voltage supply 36, which is smaller than $V_{BIAS}$.

In the lower or ON position of switch 34 transistor 26 will conduct IN to node 12 thereby turning the current mirror on. For this condition transistors 27–29 will be off. The current mirror will reflect the current in supply 14 at terminal 13.

With switch 34 in the upper position (OFF) transistor 26 will be off and transistors 27–29 on. Resistors 31–33 will distribute $I_{IN}$ in transistors 27–29. These three currents will turn transistors 40–42 on. Transistor 40 will pull node 12 up to $+V_S$. Transistor 42 will pull the base of transistor 17 up to $+V_S$. Transistor 42 will pull the base of transistor 17 up to $+V_S$. Thus, transistors 40–42 ensure that the current mirror will be off when switch 34 is in the upper position. Resistors 37–39 ensure that transistors 40–42 will be off when switch 34 is in the ON position.

The circuit of FIG. 5 functions in a similar manner to that of circuits of FIGS. 1 and 3. Also, the power transistor of FIG. 4 can be connected to the circuit of FIG. 5 to increase the output current capability.

The circuit of the invention has been described and its operation detailed. When a person skilled in the art reads the foregoing description, alternatives and equivalents, within the spirit and intent of the invention, will be apparent. For example, in FIG. 1, transistor 22 can be eliminated and the juncture of resistors 18 and 19 connected directly to the collector of transistor 16 to create a conventional current mirror configuration. Therefore, it is intended that the scope of the invention be limited only by the following claims.

I claim:

1. In a current mirror having a diode coupled input transistor driving an output transistor in response to a current input signal, means for speeding up the turn on of output current and for providing substantial transient overshoot in response to a turn on of said current input signal comprising:

means for coupling said current input signal directly to said output transistor; and means for delaying the turn on of said input transistor.

2. The current mirror of claim 1 wherein said means for diode coupling said input transistor comprise an emitter follower transistor connected to couple the base of said input transistor to its collector.

3. The current mirror of claim 1 wherein said means for diode coupling said input transistor comprise diode connecting said output transistor and a transistor connected in cascode with said output transistor, said cascode connected transistor having a base coupled to said input transistor collector, an emitter coupled to said output transistor collector and a collector coupled to provide said mirror output current.

4. The current mirror of claim 2 or claim 3 wherein said means for delaying comprise a low pass resistance capacitance filter coupled in series with said base of said input transistor.

5. The current mirror of claim 4 wherein a second resistor is coupled in series with the base of said output transistor and a diode is connected in parallel with said resistor, said diode being poled to conduct when said emitter follower transistor conducts and wherein said second resistor has a value chosen so that said diode does not conduct current after the turn-on transient period.

6. The current mirror of claim 5 wherein said second resistor is ratioed inversely with respect to the resistor in said means for delaying by the current mirror current gain.

* * * * *